United States Patent [19]

Anderson

[11] Patent Number: 4,788,705

[45] Date of Patent: Nov. 29, 1988

[54] HIGH-INTENSITY X-RAY SOURCE

[75] Inventor: Weston A. Anderson, Palo Alto, Calif.

[73] Assignee: Varian Assoicates, Inc., Palo Alto, Calif.

[21] Appl. No.: 5,973

[22] Filed: Jan. 21, 1987

Related U.S. Application Data

[63] Continuation of Ser. No. 683,988, Dec. 20, 1984, abandoned.

[51] Int. Cl.[4] ..... H01J 35/24

[52] U.S. Cl. ..... 378/121; 378/101; 378/125; 378/144

[58] Field of Search ..... 378/125, 135, 121, 138, 378/101, 136, 144, 143

[56] References Cited

U.S. PATENT DOCUMENTS

| | | | |
|---|---|---|---|
| 2,111,412 | 3/1938 | Ungelenk | 313/278 |
| 2,493,606 | 1/1950 | Waterton . | |
| 2,900,543 | 8/1959 | Hease | 378/143 |
| 3,992,633 | 11/1976 | Braun et al. . | |
| 4,060,731 | 11/1977 | Rissi | 378/109 |
| 4,068,127 | 1/1978 | Goodenough . | |
| 4,229,657 | 10/1980 | Bensussan et al. . | |
| 4,250,425 | 2/1981 | Gabby et al. . | |
| 4,323,781 | 4/1982 | Baumann et al. | 378/4 |
| 4,417,171 | 11/1983 | Schmitmann . | |
| 4,622,687 | 11/1986 | Whitaker et al. . | |
| 4,651,336 | 3/1987 | Le Guen et al. . | |
| 4,658,414 | 4/1987 | Geldner . | |

FOREIGN PATENT DOCUMENTS

| | | | |
|---|---|---|---|
| 0574865 | 4/1933 | Fed. Rep. of Germany . | |
| 1614785 | 12/1970 | Fed. Rep. of Germany . | |
| 2329067 | 5/1977 | France . | |
| 58-76142 | 9/1983 | Japan . | |
| 61-61356 | 3/1986 | Japan . | |
| 0640694 | 7/1950 | United Kingdom . | |
| 0858417 | 1/1961 | United Kingdom | 378/125 |

OTHER PUBLICATIONS

Gunn, "X-Ray Tube Having Anode with Compound Motion", IBM Technical Disclosure Bulletin, vol. 17, No. 10, Mar. 1985, pp. 3044–3046.

Translation of French Patent Application Publication No. 2,329,067.

*Primary Examiner*—Carolyn E. Fields

*Assistant Examiner*—David P. Porta

*Attorney, Agent, or Firm*—Stanley Z. Cole; Gerald M. Fisher; Terrence E. Dooher

[57] ABSTRACT

A high-intensity X-ray source generates significant heat at the anode. To help dissipate this heat, the anode is often rotated in the vacuum. Heat must still be radiated from the anode to the exterior walls. An improved X-ray source incorporates the anode in the walls of the vacuum chamber and rotates the entire chamber. The heat is then easily conducted to the exterior where it may be dissipated by connection or forced air cooling.

24 Claims, 3 Drawing Sheets

HIGH-INTENSITY X-RAY SOURCE

This application is a continuation of application Ser. No. 683,988, filed Dec. 20, 1984, now abandoned.

FIELD OF THE INVENTION

This invention pertains to apparatus for generating high-intensity X-rays, particularly to apparatus for X-ray generation with forced liquid or gas cooling of the anode while maintaining the high vacuum within the interior of the apparatus without the use of vacuum-tight rotating joints.

BACKGROUND OF THE INVENTION

High intensity X-ray sources are in increasing demand for applications such as for X-ray lithography for producing integrated circuits, computerized tomography for X-ray imaging, and for X-ray diffraction for analyzing materials. High intensity X-ray sources can be constructed by impinging a high intensity beam of electrons on an anode, but cooling the anode becomes a significant technical problem.

U.S. Pat. No. 1,160,177 to Kelley discloses an X-ray tube which uses an externally applied cooling medium with a fixed anode.

Some improvement in distributing the heat from the beam can be achieved by steering the electron beam to different parts of the anode. U.S. Pat. Nos. 2,229,152 to Walsweer and 4,336,476 to Holland disclose an anode sealed entirely in the vacuum which rotates in response to the field from coils exterior to the vacuum. The heat from the anode must be conducted through bearings or radiated through the vacuum to an external cap.

U.S. Pat. No. 4,128,781 to Flisikowski et al discloses an X-ray tube having a cathode rotatable relative to an anode. Electrons from a rotating cathode are incident on a stationary anode ring. The X-rays are emitted from different positions in space as the cathode is rotated. For many applications, it is important that the X-rays be emitted from a position fixed in space.

OBJECT OF THE INVENTION

An object of the invention is to provide an X-ray source tube with an anode which is directly cooled by a liquid or gas without requiring a rotating vacuum-tight seal and with the X-rays emitted from a position fixed in space.

BRIEF SUMMARY OF THE INVENTION

The anode of the X-ray source is part of the exterior cylindrical chamber. Water, air or other cooling fluid maintains thermal contact with the exterior wall of the anode and provides cooling as the exterior wall rotates on bearings. Air may be directed at the exterior wall to provide the cooling or a liquid coolant may be channeled within the exterior wall to provide the cooling.

These and further constructional and operational characteristics of the invention will be more evident from the detailed description given hereinafter with reference to the figures of the accompanying drawings which illustrate preferred embodiments and alternatives by way of non-limiting examples.

DETAILED DESCRIPTION OF THE PREFERRED EMBODIMENTS

Figure 1:
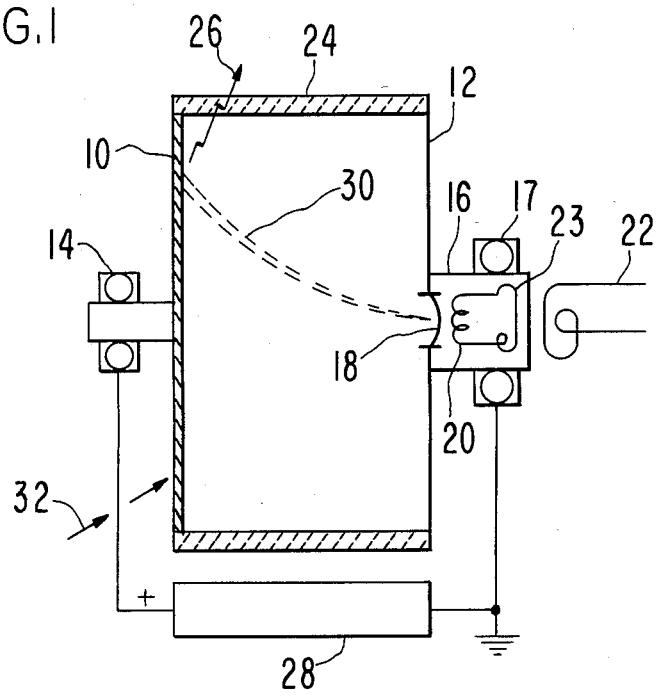
FIG. 1 is a schematic view of an X-ray source having an anode at one end of a cylindrical rotating chamber and a fixed cathode on the axis of rotation.

Referring now to the drawings wherein reference numerals are used to designate parts throughout the various figures thereof, there is shown in FIG. 1 a rotating anode X-ray source. The anode 10 is one end wall of an evacuated chamber 12. A dispenser cathode 18 and indirect heater 20 are mounted inside the bearing cathode structure 16. A rotating transformer consisting of primary coil 22 outside the evacuated chamber 12 and secondary coil 23 inside the evacuated chamber couples radio frequency power to the indirect heater 20. Alternatively slip rings (not shown) are used to provide the power to the heater within the evacuated chamber. The cylindrical wall 24 is made of ceramic material to insulate the ends and to facilitate passage of the X-ray beam 26. A high voltage source 28 is connected across the end walls. A magnetic field normal to the paper bends and focuses the electron beam 30 off axis striking the inside of the anode 10. A stream of cooling gas 32 is used to cool the anode 10. In operation the evacuated chamber 12 including anode 10 is caused to rotate, supported by bearings 14 and 17 which are fixed in the laboratory. The magnetic field is maintained in a fixed position in the laboratory so that the region in which the X-rays are generated does not move as the anode rotates. If desired, the cooling gas stream 32 may be used to spin evacuated chamber 12. Alternatively, an electric motor (not shown) may be mechanically coupled to evacuated chamber 12 to cause it to rotate.

Circular fins can be placed on the outside of the vacuum chamber to aid in dissipating heat. Radial fins of semicircular, parabolic, hyperbolic or other curved shape could be used in conjunction with an airstream directed at the device to both cool and drive the rotation of the vacuum chamber.

Figure 2:
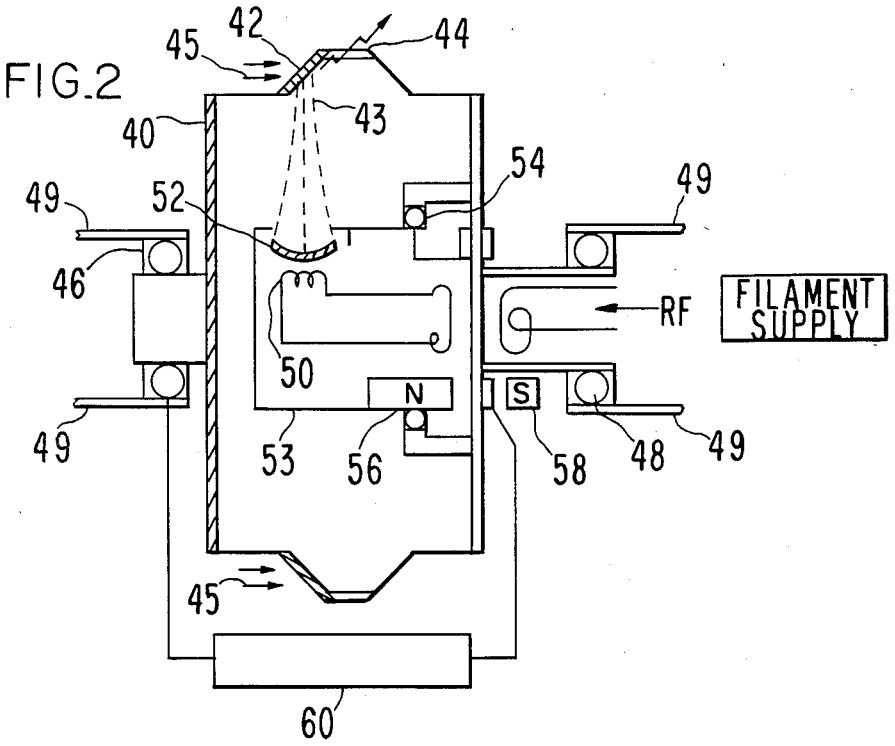
FIG. 2 is a schematic view of an X-ray source having an anode in the cylindrical wall of a rotating cylindrical chamber with an internal cathode that is fixed in space.

Another embodiment shown in FIG. 2 uses a cylindrical chamber 40 in which a cylindrical anode 42 and window 44 for X-rays form the cylindrical wall. External bearings 46 and 48 permit the entire chamber to rotate. An indirect heater 50 and focusing structure 52 are mounted on internal bearings 54. A pair of magnets, one magnet 56 mounted inside the chamber on the electron source and another magnet 58 fixed outside the chamber 40, is used to prevent the internal structure from rotating as the chamber 40 is rotated. External magnet 58 and bearing 48 are maintained fixed in the laboratory by structural member 49. Internal bearings 54 permit the internal cathode structure 53 to remain fixed relative to the laboratory as the cylindrical chamber 40 rotates. A high voltage supply 60 is connected through bearing 46 or via slip rings (not shown) from the electron source to the anode 42. Although anode 42 rotates, the position of the electron beam 43 remains fixed with respect to the laboratory so that the region in which the X-rays are generated also remains fixed in the laboratory. The external surface of anode 42 may be cooled by gas stream 45 or by a liquid system that will be explained more fully in FIG. 5. Chamber 40 may be rotated by a gas stream or motor as desired.

Figure 3A:
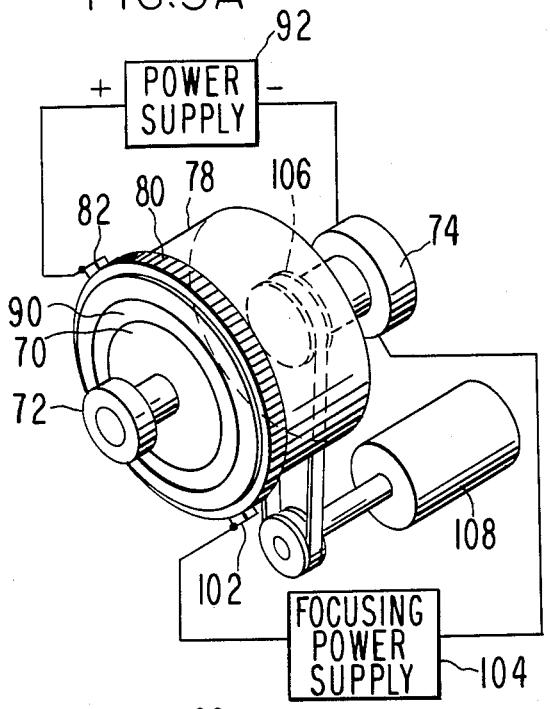
FIG. 3A is a perspective view of an X-ray source having segments on the periphery of the rotating structure.

Another embodiment shown in FIG. 3 again uses a cylindrical structure 70 mounted on bearings 72 and 74. The anode 76 is arranged as a series of short segments electrically insulated from each other mounted on insulating cylinder 78. These segments are individually wired to an external commutator 80 to which the anode high voltage is applied through a set of brushes 82. The brushes may cover several commutator strips simultaneously so that the anode voltage remains applied to the anode segments in a fixed spatial location with respect to the laboratory. In this way the electrons which are generated by cathode 84 on the spin axis are focused on the same region (in the fixed coordinate system) as the anode rotates. The individual anode segments are insulated from each other. The metal anode material may be spatially overlapped so that the focused electron beam always strikes anode material and not the insulating material. The X-rays 88 are extracted through a suitable window 90 adjacent to the anode or may be extracted from the back of the material.

Power supply 92 supplies a positive voltage to the anode segments 76 as they rotate into position. Focusing and directing the electron beam 94 from cathode structure 84 is achieved by the positive potential supplied by power supply 92. Additional focusing control can be achieved by placing a suitable voltage on focusing electrode 96 and applying suitable voltages upon other anode segments by one or more additional commutator brushes 102. The focusing electrode 96 and commutator brushes 102 receive proper focusing voltages from power supply 104.

Figure 3B:
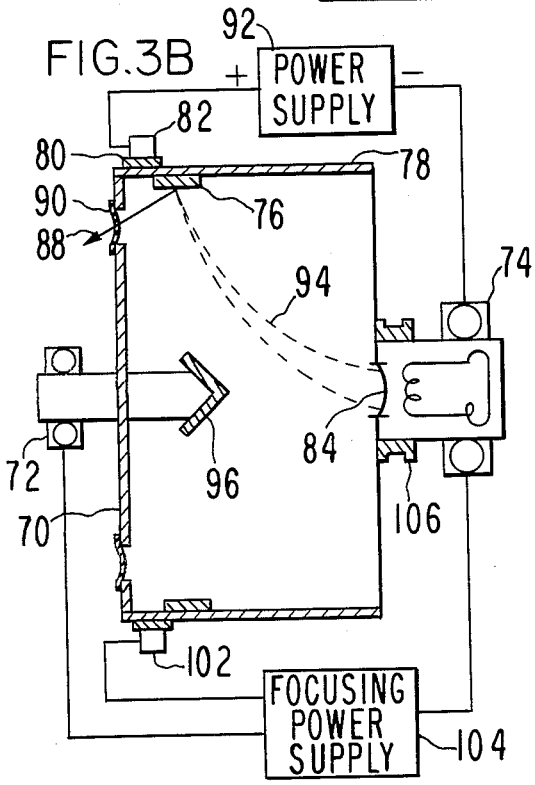
FIG. 3B is a sectional view from the side of the embodiment in FIG. 3A.

Cylindrical structure 70 may be rotated by attached pulley 106 coupled by a belt to a motor 108 (not shown in FIG. 3B).

Figure 4A:
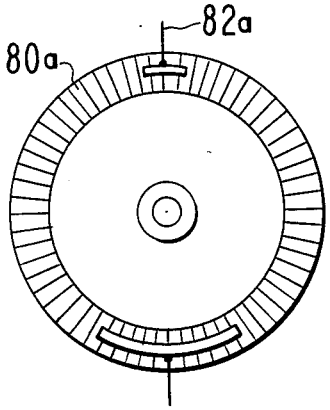
FIG. 4A is an end view of an X-ray source having a segmented rotating anode with the segments on the end of the rotating structure.
Figure 4B:
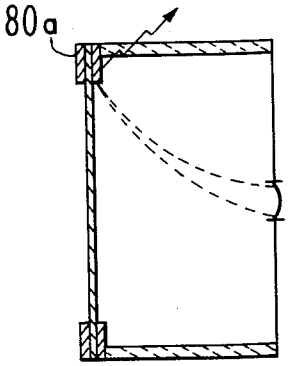
FIG. 4B is a sectional view from the side of the embodiment of FIG. 4A.

An alternative commutator arrangement is shown in FIGS. 4A and 4B. Here the anode 80*a* and commutator 82*a* are located on the end of the rotating cylindrical structure.

The segmented anode systems described so far had separate anode segments on the inside of an insulating cylinder or disk connected by an electrical feed-through to a commutator segment on the outside of the cylinder or disk. Using brazing techniques, one can construct a cylinder or disk structure that contains anode segments alternating with ceramic insulating segments so that the exterior of the anode segments is used as the commutator.

Figure 5:
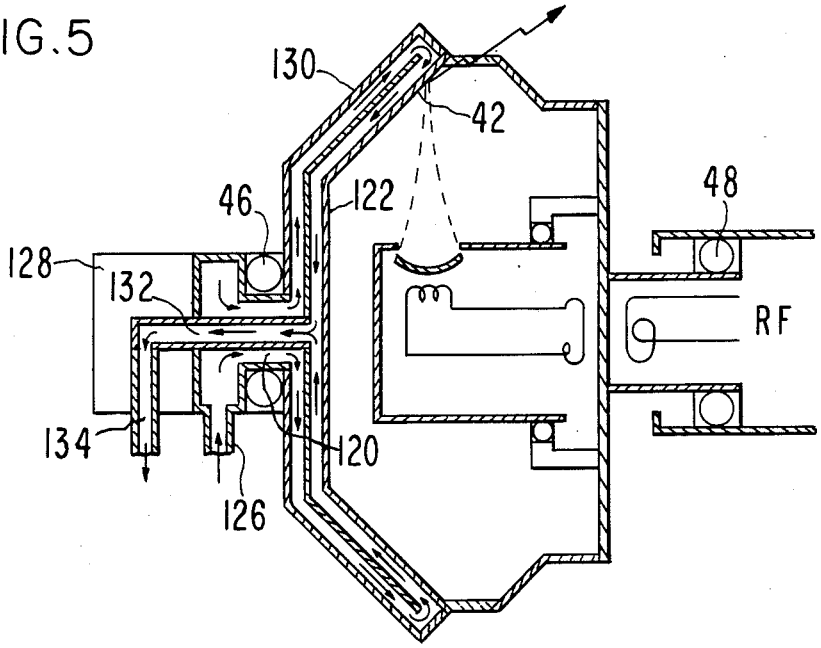
FIG. 5 is a schematic sectional view of an X-ray source with an anode in the internal wall of a rotating vacuum chamber and a liquid cooling system on the external wall of said rotating vacuum chamber.

Another embodiment shown in FIG. 5 uses a fluid such as water to provide cooling of the anode. The interior configuration of FIG. 5 is similar to that of FIG. 2. In FIG. 5 the rear of anode 42 is in immediate contact with a fluid 120 which may be water. The fluid flows into a hollow section 120 of the rotating shaft that supports the vacuum chamber 122. The shaft is supported by bearings 46. The fluid enters the hollow section 120 through the chamber 126 of fluid seal 128. The cooling fluid flows within bearing 46 and provides cooling to it if needed, and then flows through structure 130 which channels the water past anode 42, providing cooling to the back side of the anode. The water then flows out through a hollow center section 132 of the rotating shaft and out through chamber 134 of fluid seal 128. This cooling arrangement is extremely effective since any gas bubbles that are formed at the back of the anode surface 42 are immediately swept out by the high centrifugal force on the liquid produced by the rapidly rotating structure.

This invention is not limited to the preferred embodiments heretofore described, to which variations and improvements may be made, without leaving the scope of protection of the present patent, the characteristics of which are summarized in the following claims.

What is claimed is:

1. An X-ray source comprising:

a housing forming a vacuum chamber, the entirety of said housing being rotatable about an axis, a portion of said housing being an anode;

means for rotating said housing about said axis;

means, mounted within said chamber, for generating electrons and for focusing said electrons onto a region off said axis;

rf transformer means for inductively coupling rf energy from a source external to said vacuum chamber through a wall portion of said housing to said means for generating electrons, said transformer means comprising a primary coil mounted outside of said vacuum chamber and a secondary coil mounted within said vacuum chamber, said secondary coil having an air core; and means for holding said means for generating and for focusing fixed when said housing is rotated about said axis so that said region remains fixed and said anode rotates through said region.

2. An X-ray source as in claim 1 wherein said housing comprises a first end, a second end and a wall joining said first end to said second end so that said housing has a generally cylindrical shape.

3. An X-ray source as in claim 2 wherein said wall includes said anode.

4. An X-ray source as in claim 3 wherein said anode comprises a conical ring and wherein a window for X-rays generated by said electrons striking said anode is proximate said conical ring.

5. An X-ray source as in claim 1 wherein said means for holding comprises:

bearings, said means for generating and for focusing being fixedly mounted on a structure supported by said bearings;

a first magnetic means fixedly mounted on said structure; and a second magnetic means fixedly mounted outside said chamber opposite said first magnetic means.

6. An X-ray source as in claim 1 further including means for cooling said anode by conveying a fluid to an external side of said anode.

7. An X-ray source as in claim 6 wherein said means for conveying comprises:

means for receiving said fluid from an external source;

means for returning said fluid to an external sink; and channel means for conveying said fluid from said means for receiving to an external side of said anode and from said external side of said anode to said means for returning.

8. An X-ray source as in claim 1 wherein said secondary coil consists of a single turn.

9. An X-ray source as in claim 1 wherein said secondary coil has an axis coinciding with said axis about which said housing is rotatable.

10. An X-ray source comprising:

a housing forming a vacuum chamber, the entirety of said housing being rotatable about an axis, said housing including an anode comprising a plurality of electrically conducting portions off said axis and equidistant from said axis and separated from one another by electrically insulating material;

means for rotating said housing about said axis;

means, fixedly mounted within said chamber on said axis and symmetric with respect to said axis, for generating electrons and for focusing said electrons;

means for applying a first electrical potential to said means for generating and for focusing; and means for applying a second electrical potential greater than said first electrical potential to those electrically conducting portions passing through a fixed spatial region when said housing is being rotated, so that said electrons are attracted to impinge on said portions passing through said fixed spatial region.

11. An X-ray source as in claim 10 wherein said portions overlap so that said electrons do not impinge on said insulating material.

12. An X-ray source as in claim 10 further including an electrode fixedly mounted in said vacuum chamber for directing electrons generated by said means for generating and for focusing to impinge on those electrically conducting portions passing through said fixed spatial region.

13. An X-ray source as in claim 10 further including means for applying a third electrical potential to selected ones of said electrically conducting portions not in said fixed spatial region so that said electrons generated by said means for generating are directed toward said electrically conducting portions passing through said fixed spatial region.

14. An X-ray source as in claim 10 wherein said housing comprises a cylinder having a first end and a second end and a wall portion of said housing connecting said first end to said second end.

15. An X-ray source as in claim 14 wherein said wall portion comprises said plurality of electrically conducting portions.

16. An X-ray source as in claim 14 wherein said first end portion comprises said plurality of electrically conducting portions.

17. An X-ray source as in claims 10, 11, 12, 13, 14, 15 or 16 further including means for cooling said anode.

18. An X-ray source as in claim 11 wherein said means for cooling comprises:

means for receiving a fluid from an external source, means for returning said fluid to an external sink, and channel means for conveying said fluid from said means for receiving to said anode and from said anode to said means for returning.

19. An X-ray source comprising:

a vacuum chamber;

means for generating electrons mounted within said vacuum chamber;

an anode having a surface within said vacuum chamber for receiving electrons generated by said means for generating; and rf transformer means for inductively coupling rf energy from a source external to said vacuum chamber through a wall of said vacuum chamber to said means for generating electrons, said transformer means comprising a primary coil positioned outside of said vacuum chamber and a secondary coil mounted within said vacuum chamber, said secondary coil having an air core.

20. An X-ray source as in claim 19 wherein said vacuum chamber is rotatable about an axis.

21. An X-ray source as in claim 19 wherein said secondary coil consists of a single turn.

22. An X-ray source as in claim 19 further including means for rotating said vacuum chamber about an axis and wherein said secondary coil has an axis coinciding with said axis about which said vacuum chamber is rotatable.

23. An X-ray source comprising:

a housing forming a vacuum chamber, the entirety of said housing being rotatable about an axis, a portion of said housing being an anode;

means for rotating said housing about said axis;

means, mounted within said chamber, for generating electrons and for focusing said electrons onto a region off said axis;

rf transformer means for inductively coupling rf energy from a source external to said vacuum chamber through a wall portion of said housing to said means for generating electrons, said transformer means comprising a primary coil mounted outside of said chamber and a secondary coil mounted within said vacuum chamber, said secondary coil having an axis coinciding with said axis about which said housing is rotatable; and means for holding said means for generating and for focusing fixed when said housing is rotated about said axis so that said region remains fixed and said anode rotates through said region.

24. An X-ray source comprising:

a vacuum chamber;

means for rotating said vacuum chamber about an axis;

means for generating electrons mounted within said vacuum chamber;

an anode having a surface within said vacuum chamber for receiving electrons generated by said means for generating; and rf transformer means for inductively coupling rf energy from a source external to said vacuum chamber through a wall of said vacuum chamber to said means for generating electrons, said transformer means comprising a primary coil positioned outside of said vacuum chamber and a secondary coil mounted within said vacuum chamber, said secondary coil having an axis coinciding with said axis about which said vacuum chamber is rotatable.

* * * * *